United States Patent [19]

Schweitzer, Jr.

[11] Patent Number: 4,536,758

[45] Date of Patent: Aug. 20, 1985

[54] FAULT INDICATOR WITH PUSH BUTTON RESET

[76] Inventor: Edmund O. Schweitzer, Jr., 1002 Dundee Rd., Northbrook, Ill. 60118

[21] Appl. No.: 474,132

[22] Filed: Mar. 10, 1983

[51] Int. Cl.[3] ..... G08B 21/00

[52] U.S. Cl. ..... 340/664; 340/659; 324/133

[58] Field of Search ..... 324/133, 127, 51; 340/664, 659, 657; 116/204, 267

[56] References Cited

U.S. PATENT DOCUMENTS

| | | | |
|---|---|---|---|
| 3,413,548 | 11/1968 | Schweitzer, Jr. | 324/133 |
| 3,996,881 | 12/1976 | Schneider | 116/204 X |
| 4,375,617 | 3/1983 | Schweitzer, Jr. | 324/133 |

*Primary Examiner*—James L. Rowland

*Assistant Examiner*—Jeffery A. Hofsass

*Attorney, Agent, or Firm*—Lockwood, Alex, Fitzgibbon & Cummings

[57] ABSTRACT

A fault indicator for indicating the occurrence of a fault current in an electrical conductor includes a rotatable indicator flag having fault-indicating and reset-indicating positions in response to applied magnetic fields. Upon occurrence of a fault current the indicator flag is set to the fault-indicating position by a first magnetic field generated by current flow through the conductor. Upon termination of the fault current the flag indicator is manually reset to the reset-indicating position by a permanent magnet, which is user-displaceable from a magnetically shielded position within the indicator housing to a position in magnetic communication with the flag indicator.

23 Claims, 9 Drawing Figures

FIG. 1
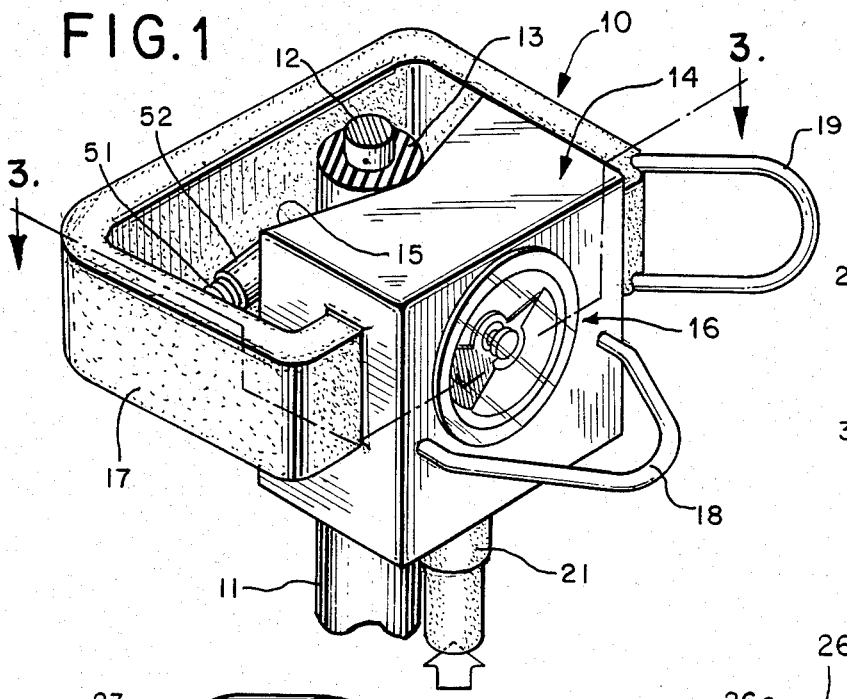
FIG. 6
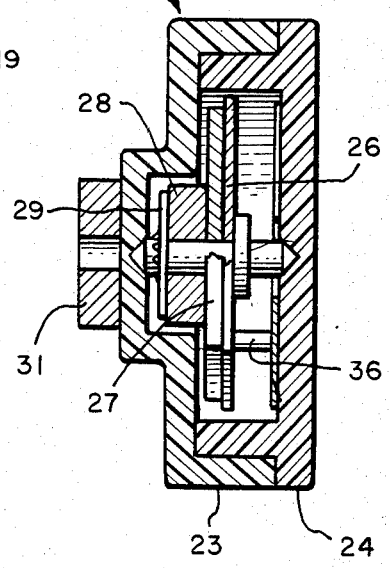
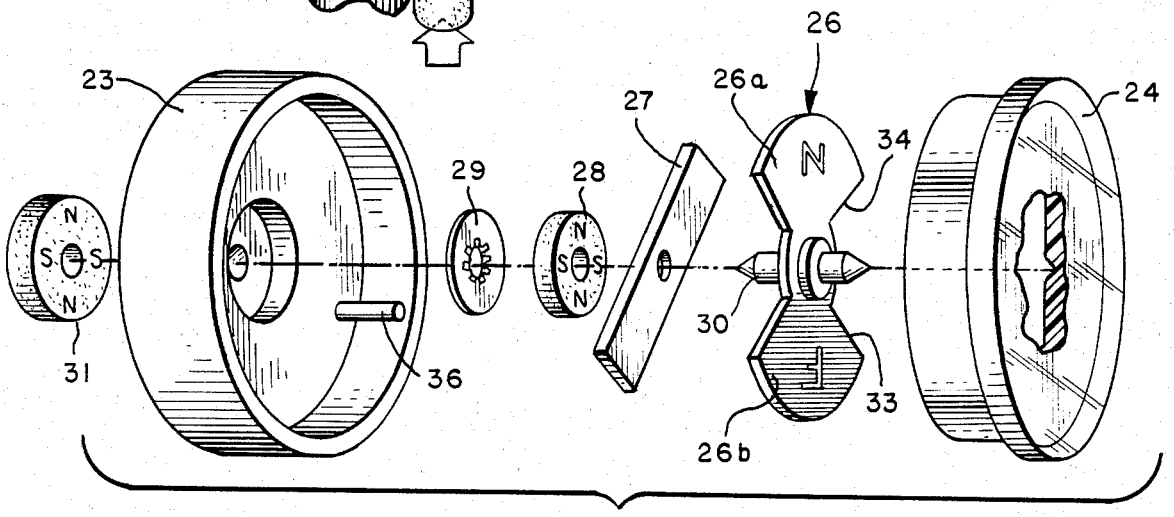
FIG. 5
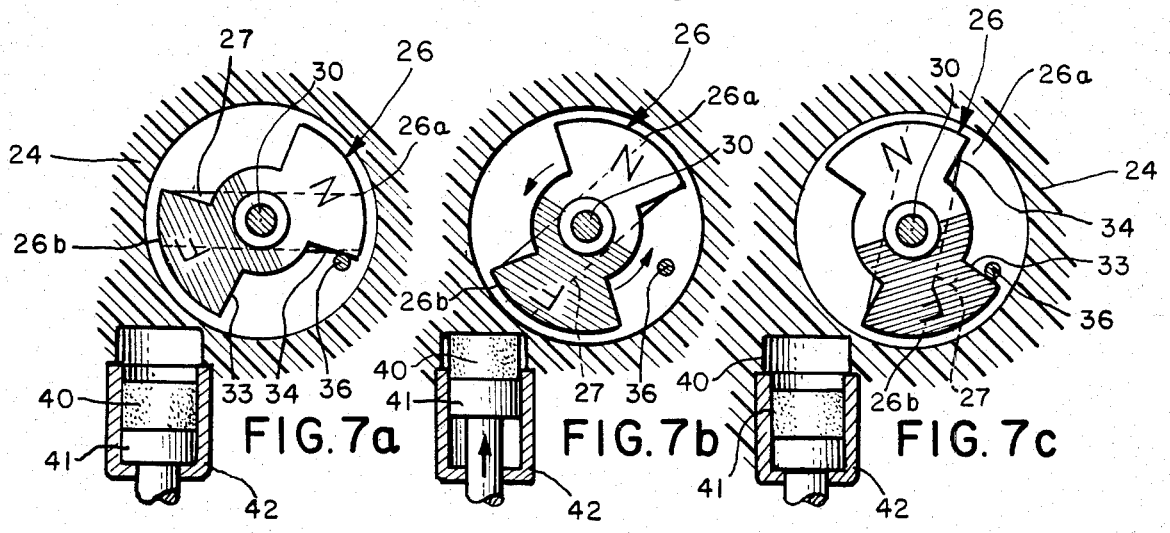
FIG. 7a FIG. 7b FIG. 7c FIG. 2
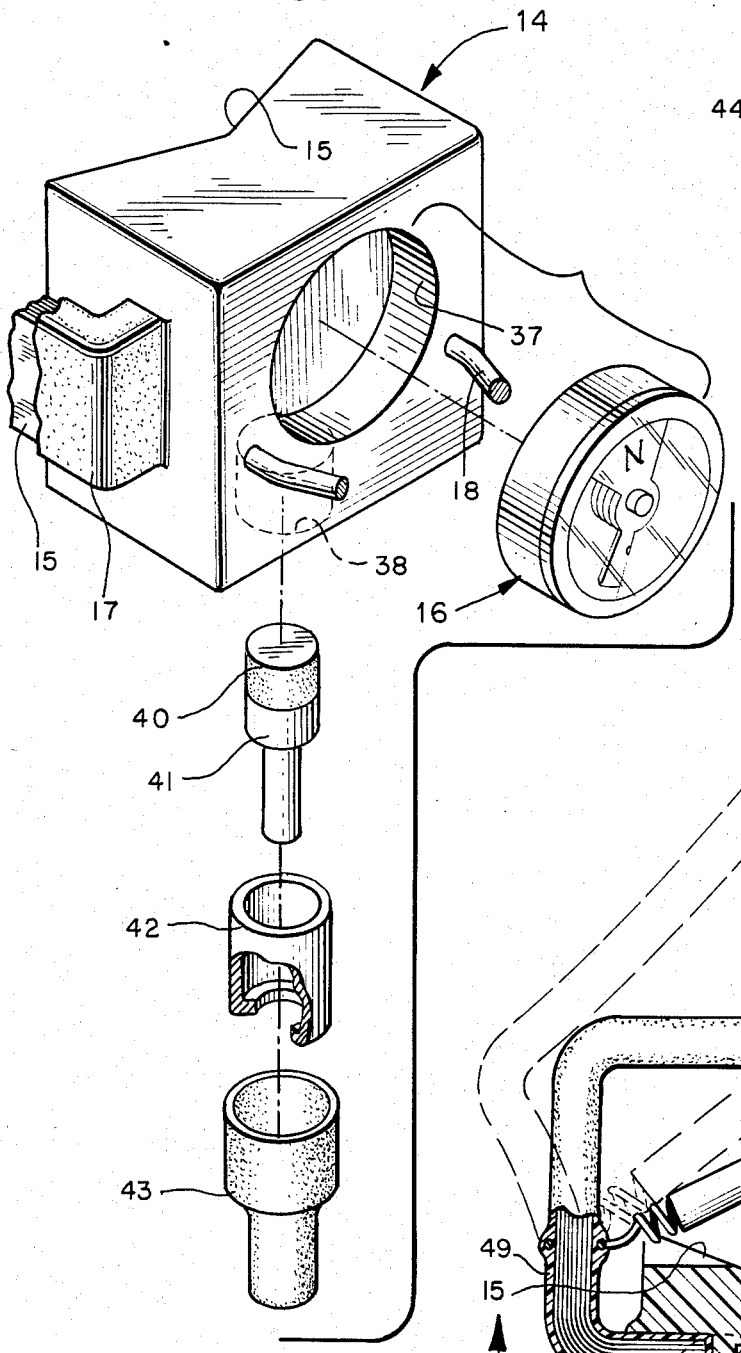
FIG. 4
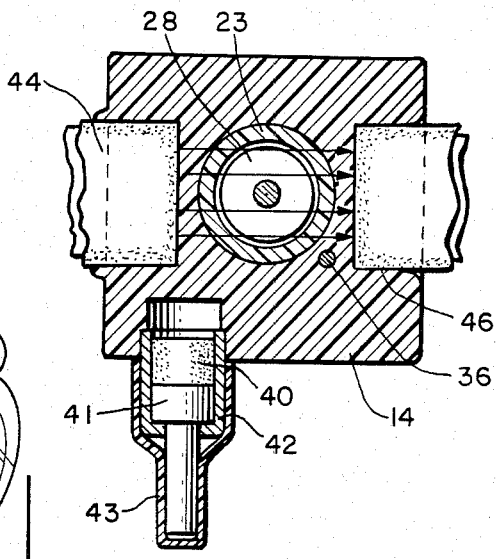
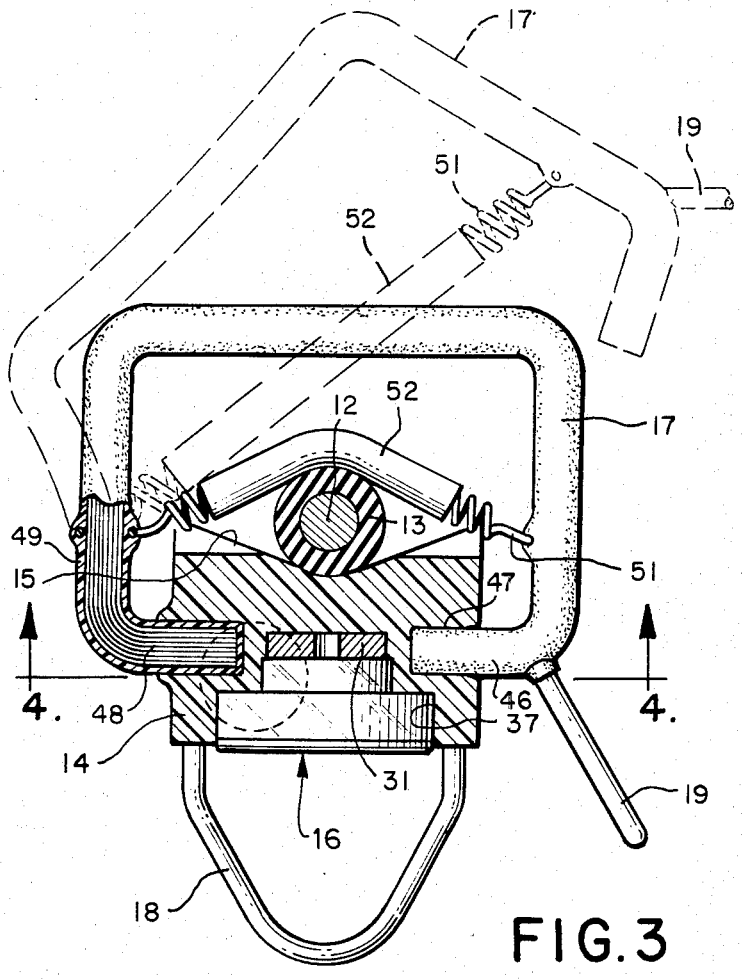
FIG. 3

FAULT INDICATOR WITH PUSH BUTTON RESET

BACKGROUND OF THE INVENTION

This invention relates generally to fault indicators, and more particularly to non-self resetting fault indicators which include user-actuable reset means, such as described in U.S. Pat. Nos. 3,413,548 and 4,086,529 of the present inventor. This invention constitutes an improvement in such fault indicators.

Fault indicators are generally installed on conductors in commercial electrical power distribution systems. In such distribution systems a short circuit, or fault, may develop, resulting in loss of service to consumers. Following the occurrence of such a fault it is necessary that the fault be quickly located and repaired to enable service to be restored.

Fault indicators are typically installed on a conductor and are constructed in such a manner that when the current flowing through the conductor exceeds a predetermined level an indicator is tripped to a fault-indicating state to indicate that such excessive current has occurred. Fault indicators placed on conductors which do not experience a fault current remain in an untripped or reset-indicating state. By systematically inspecting the fault indicators located at various points in the power distribution system, the fault can be quickly located and repaired.

Generally when a fault occurs within a power distribution system a circuit breaker in the system trips, cutting off current to a portion of the system. Since no current flows in affected conductors in the system, fault indicators for use in such systems are constructed in such a manner that an indication of the excessive current flow remains following the occurrence of the fault, even through the current immediately following the fault may have dropped to zero. A fault indicator in such a condition is said to be in a "tripped" state, and is no longer able to indicate the occurrence of a subsequent fault current. In order to make the indicator operative once again, it is necessary that the indicator be reset to a "reset" state.

One form of prior manually-reset fault indicator, as described in U.S. Pat. No. 3,413,548, utilized a rotatably mounted bi-stable indicator flag having reset-indicating and fault-indicating positions to visually indicate tripped and reset states. This fault indicator was reset by means of a reset tool having a permanent magnet which was positioned in close proximity to the fault indicator by a lineman to magnetically reposition the indicator flag to its reset position. This was often a cumbersome process, in that it was necessary for the lineman to carry a special reset tool, and to accurately position the tool relative to the indicator housing in an often dark and cramped environment. This was particularly disadvantageous where it was necessary to individually reset a large number of fault indicators, since the burden in the reset procedure was multiplied many times over.

In another form of prior manually-reset fault indicators, as described in U.S. Pat. No. 4,086,529, the indicator flag was positioned to its fault-indicating position by a pole piece magnetized by the fault current, and repositioned to its reset-indicating position by a reset tool having a magnetic winding which remagnetized the pole piece. This also required accurate placement of the reset tool.

Another prior fault indicator utilized a spring-biased indicator flag which was mechanically latched upon reaching a fault-indicating position. Reset was accomplished by displacing the latch to allow the spring to return the indicator flag to its reset position.

Another prior fault indicator provided a permanent magnet externally mounted to the indicator housing which could be pivoted or otherwise positioned so as to interact with the indicator flag to reposition the indicator to its reset position. The arrangement had the disadvantage of being bulky, expensive, and prone to mechanical breakdown.

Thus a need exists for a fault indicator having simple, reliable self-contained user-actuable reset means, which avoids the disadvantages of prior constructions.

Accordingly, it is an object of this invention to provide a new and improved user-resettable fault indicator.

It is another object of the present invention to provide a self-contained manually-resettable fault indicator which can be conveniently reset without the need for external reset tools.

SUMMARY OF THE INVENTION

A fault indicator for indicating the occurrence of a fault current in an electrical conductor includes indicator means responsive to a first applied magnetic field for indicating the occurrence of a fault current in the conductor, and responsive to a second applied magnetic field for indicating the presence of a reset condition in the conductor. Trip detection means in magnetic communication with the conductor apply a first magnetic field to the indicator means to indicate a fault condition upon the occurrence of a fault current. User-actuable reset means including a permanent magnet apply a second magnetic field to the indicator means to condition the indicator to a reset state.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

FIG. 1 is a perspective view of a fault indicator constructed in accordance with the invention installed on an electrical conductor.

FIG. 2 is an exploded perspective view of the fault indicator of FIG. 1 showing the indicator flag assembly and push button reset components thereof.

FIG. 3 is a cross-sectional view taken along line 3—3 of FIG. 1 and showing the fault indicator clamped in place on the conductor.

FIG. 4 is a cross-sectional view of the fault indicator taken generally along line 4—4 of FIG. 3.

FIG. 5 is an exploded perspective view showing the principal components of the indicator flag assembly of the fault indicator.

FIG. 6 is a sectional view of the indicator flag assembly taken along line 6—6 of FIG. 2.

FIG. *7a* is a simplified diagrammatic representation of the principal components of the push button reset mechanism and indicator flag assembly in a fault-indicating condition.

FIG. *7b* is a diagrammatic representation similar to FIG. *7a* showing the reset assembly actuated to reset the indicator flag assembly to a reset-indicating condition.

FIG. 7c is a diagrammatic representation similar to FIG. 7a showing the reset mechanism and indicator flag assembly in a reset-indicating condition.

DESCRIPTION OF THE PREFERRED EMBODIMENT

Referring to the Figures, and particularly to FIG. 1, a manually reset fault indicator 10 is shown installed in an operating position along an electrical conductor 11. Conductor 11, which is of a conventional type suitable for the commercial distribution of electrical power, comprises a central metallic conducting element 12 surrounded by an insulating sheath 13.

The fault indicator 10 comprises a housing block 14 in which are mounted an indicator flag assembly 16, a magnetic pole piece 17, a pair of handling members 18, 19, and a push button reset mechanism 21. The indicator flag assembly 16, which is preferably of the type disclosed in U.S. Pat. No. 3,413,548, is responsive to the application of external magnetic fields. More specifically, and as described in the reference, indicator assembly 16 is a bi-stable device having a normal or "reset" position, and a fault or "tripped" condition. The reset condition is that which normally exists while the fault indicator is in operation on a properly operating power distribution circuit. In this condition the fault indicator is responsive to excess current in the conductor on which the fault indicator is placed. If the current in the conductor exceeds a predetermined value, the flag indicator assembly is conditioned to the fault or tripped condition which results in a visual indication that the fault current has occurred. In FIG. 1, the fault indicator is shown in such a tripped condition, as is indicated by the letter F being visible on the face of the flag indicator assembly.

The housing block 14 is provided with a notch on its rear surface into which is positioned the electrical conductor. To provide a magnetic field indicative of the current in this conductor, the fault indicator 10 includes flux concentrating means in the form of the generally ring shaped magnetic pole piece 17 for the purpose of applying an externally induced magnetic field to the flag indicator assembly 16. Magnetic pole piece 17 also serves as a clamp to hold the fault indicator in place on the conductor. Handling members 18 and 19 are connected to the pole piece and the housing block respectively and are designed to be engaged by a special live line tool (not shown) carried by the lineman installing the fault indicator. The live line tool, used in conjunction with handling members 18 and 19, enables the lineman to safely position the fault indicator on a live electrical conductor.

Referring to FIGS. 5 and 6, the flag indicator assembly comprises a generally cylindrical flag indicator housing 23 and a transparent face place 24 which together form a sealed enclosure. Within the enclosure are positioned an indicator flag 26, a magnetic armature 27, an annular magnet 28, a spring clamp washer 29, and a pivot shaft 30, all mounted for rotation along the axis of the housing. A stationary permanent magnet 31 is affixed to the outer rear surface of the indicator housing. Both the stationary magnetic 31 and the rotatable magnet 28 are annular in form, and contain four magnetic poles as shown.

The rotatable magnet 28, the armature 27 and the spring clamp washer 29 are each fixedly attached to pivot shaft 30, which is received in bearing surfaces in housing sections 23 and 24 to provide for free rotation of the assembly. The indicator flag, armature, rotatable magnet and spring clamp washer rotate through an arc determined by a sector removed from the periphery of the indicator flag. At the limits of rotation, the edges 33 or 34 of the sector engage a mechanical stop in the form of a pin 36 in the indicator housing, which prevents further rotation.

The indicator flag is held in either of two positions through the interaction of the rotatable magnet with the stationary magnet. Specifically, the repulsive forces between the like poles of the two magnets provides sufficient bias or indexing torque to hold the indicator flag in either a fault-indicating position, wherein edge 34 abuts pin 36, as shown in FIG. 7a; or in a reset-indicating position, wherein edge 33 abuts pin 36, as shown in FIG. 7c. The indicator flag remains in one of the two positions until an external magnetic field applies sufficient torque on the magnetic armature to rotate the flag from one position to the other.

FIG. 4 shows the relative positioning of indicator flag assembly and the ends of the magnetic pole piece 17. As current flows in conductor 11, the resulting magnetic flux is concentrated by means of the magnetic pole piece and caused to appear across the ends 44 and 46 of the pole piece as shown in FIG. 4. When the indicator flag assembly 16 is in its reset position, the axis of magnetic armature 27 is at an angle with respect to the field lines. Upon the occurrence of a fault current, the magnetic field strength appearing between the ends 44 and 46 of pole piece 17 produces a torque sufficient to overcome the bias force between magnets 28 and 31 and rotate the indicator flag from the reset-indicating position to the fault-indicating position. Reference is made to previously identified U.S. Pat. No. 3,413,548 for a further explanation of indicator flag assembly 26.

FIG. 2 shows the relative positioning of the flag indicator assembly 26, and the push button reset mechanism 21. The flag indicator assembly 26 is received in a cylindrical recess 37 on the front surface (as viewed in FIG. 2) of housing block 14. The push button reset mechanism is received in a cylindrical recess 38 on the bottom face of the housing block includes, in accordance with the invention, a permanent reset magnet 40 arranged for user-selective magnetic communication with indicator flag assembly.

As shown in FIGS. 2 and 4, reset magnet 40 is arranged in axial alignment with a non-metallic actuator stem 41. The combination of magnet and plunger is dimensioned so as to be slidably received within a cylindrical magnetic shield 42 formed of a material having high magnetic conductivity such as soft iron. The protruding end of stem 41 is enclosed within a rubber boot 43 which serves to seal the reset mechanism against dirt and moisture. By pressing the stem of the plunger extending through the bottom surface of the magnetic shield, the reset magnet is displaced relative to the shield along the axis of the plunger.

FIGS. 7a, 7b and 7c illustrate the operation of push button reset mechanism 21. FIG. 7a shows indicator flag 26 in the tripped position and the push button reset mechanism in a non-actuated state. At this time magnetic shield 42 extends beyond the top surface of reset magnet 40 and serves to shield magnetic armature 27 from the magnetic field produced by the reset magnet. Consequently, the torque produced by the interaction of the field produced by the reset magnet and the magnetic armature 27 is insufficient to reposition the indicator to the reset position. However, when actuator stem 41 is depressed as shown in FIG. 7*b*, the top surface of reset magnet 40 is moved beyond the end of the magnetic shield and is brought into closer magnetic communication with magnetic armature 27. The resulting attractive force is of sufficient strength to overcome the indexing force produced by magnets 28 and 31 contained within the flag indicator assembly, causing indicator flag 26 to rotate in a counterclockwise direction as shown in FIG. 7*b* until the indicator flag reaches the reset position, as shown in FIG. 7*c*.

Once the flag indicator reaches the reset position, the indexing force produced by magnets 28 and 31 in indicator flag assembly 16 serve to hold the indicator flag in the reset position until the occurrence of the next fault condition. When actuator stem 41 is released, the interaction of reset magnet 40 with magnetic shield 42 results in a strong restoring force on the reset magnet-plunger combination which tends to restore the push button to its undepressed state. Thus, the need for a restoring spring is avoided.

FIG. 3 further illustrates the manner in which fault indicator 10 is mounted on conductor 11. One end 44 of magnetic pole piece 17 is permanently attached to housing block 14. The other end 46 of the pole piece is removably received in a recess 47 of the housing block. The pole piece, which is comprised of a plurality of flexible matallic strips 48 encased within an electrically insulating sheath 49, is flexible, and can be configured from the open position shown by the dashed line in FIG. 3 to the closed position shown by the solid lines in FIG. 3. While the pole piece is in the open position, the fault indicator can be positioned on an electrical conductor. The fault indicator can then be secured in place on the conductor by introducing the end 46 of the pole piece into recess 47 of the housing block. A coil spring 51 serves both to lock the fault indicator in position on the conductor and to bias end 46 into the recess 47. A length of rubber or vinyl tubing 52 may be positioned between spring and the conductor to protect the insulation of the conductor from chafing.

While in this embodiment resetting is accomplished by linearly displacing a disc-shaped permanent magnet with respect to a cylindrical magnetic shield so as to apply a magnetic field to indicator flag assembly 16, it will be appreciated that such resetting may be accomplished through the use of magnets and shields of other shapes, sizes and movements. Furthermore, while in this embodiment the permanent magnet is displaced relative to the magnetic shield, resetting may also be accomplished through use of a system in which the magnet remains stationary and the magnetic shield is displaced to establish magnetic communication with the indicator flag assembly.

While a particular embodiment of the invention has been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

I claim:

1. A fault indicator for indicating the occurrence of a fault current in an electrical conductor, comprising:

a housing;

indicator means in said housing having fault and reset indicating states in response to an applied magnetic field for indicating the occurrence of fault and reset conditions in the conductor;

flux concentrating means in magnetic communication with said conductor for applying a first magnetic field to said indicator means to condition said indicator means to a fault state upon the occurrence of a fault current in the conductor; and user-actuable reset means including a permanent reset magnet mounted for reciprocation within said housing for applying a second magnetic field to said indicator means upon reciprocation of said permanent magnet to condition said indicator means to a reset state.

2. A fault indicator as defined in claim 1 wherein said first magnetic field provides a first force effect in one direction on said indicator means and said second magnetic field provides a second force effect of different direction on said indicator means.

3. A fault indicator as defined in claim 1 wherein said reset means include magnetic shield means within said housing for confining the field of said magnet, and displacement means for mechanically separating said reset magnet and said shield means whereby said second magnetic field is applied to said indicator means to condition said indicator means to a reset state.

4. A fault indicator as defined in claim 3 wherein said magnetic shield is affixed to said housing and said magnet is movable.

5. A fault indicator as defined in claim 4 wherein said magnetic shield comprises a sleeve formed of a material having high magnetic conductivity, and said permanent magnet is mounted for reciprocation within said sleeve.

6. A fault indicator as defined in claim 5 wherein said magnet comprises a cylindrical form having an outside diameter corresponding to the inside diameter of said sleeve.

7. A fault indicator as defined in claim 4 including an actuator stem operatively engaging said magnet for moving said magnet along the axis of the sleeve.

8. A fault indicator as defined in claim 7 including a boot over the end of said actuator stem.

9. A fault indicator as defined in claim 4 in which the sleeve is received within an appropriately dimensioned bore within said housing.

10. A fault indicator as defined in claim 1 wherein said indicator means comprise a rotatably mounted indicator flag and an indexing magnet, and armature means rotatably coupled to said indicator flag and responsive to said first and second applied magnetic fields for positioning said indicator flag in said trip and reset states.

11. A fault indicator as defined in claim 10 further comprising magnet indexing means including a first permanent magnet mounted for rotation with said indicator flag and a second permanent member fixedly positioned relative to said housing for indexing said indicator flag alternatively in said trip and reset states.

12. A fault indicator as defined in claim 1 wherein said flux concentrating means comprise a magnetic pole piece mounted to said housing and at least partially encircling the conductor and having magnetic poles in magnetic communication with said indicator means for conditioning said indicator means to said trip condition.

13. A fault indicator as defined in claim 5 wherein said magnet has a non-actuated position within said sleeve.

14. A fault indicator for indicating the occurrence of a fault current in a conductor comprising:

a housing;

indicator means in said housing responsive to a first applied magnetic field providing a first force effect of one direction for indicating the occurrence of a fault current in the conductor and responsive to a second applied magnetic field providing a second force effect of a different direction for indicating the presence of a reset condition in the conductor;

flux concentrating means in magnetic communication with said conductor for applying said first magnetic field to said indicator means upon occurrence of the fault current; and user-actuable reset means including a permanent magnet within said housing for applying said second magnetic field to said indicator means to condition said indicator means to a reset state, magnetic shield means within said housing for confining the field of said magnet, and displacement means for mechanically separating said magnet and said shield means whereby said second magnetic field is applied to said indicator means to condition said indicator means to a reset state.

15. A fault indicator as defined in claim 14 wherein said magnetic shield is affixed to said housing and said magnet is movable.

16. A fault indicator as defined in claim 15 wherein said magnetic shield comprises a sleeve formed of a material having high magnetic conductivity, and said permanent magnet is mounted for reciprocation within said sleeve.

17. A fault indicator as defined in claim 16 wherein said magnet comprises a cylindrical form having an outside diameter corresponding to the inside diameter of said sleeve.

18. A fault indicator as defined in claim 17 including an actuator stem operatively engaging said magnet for moving said magnet along the axis of the sleeve.

19. A fault indicator as defined in claim 18 including a boot over the end of said actuator.

20. A fault indicator as defined in claim 19 in which the sleeve is received within an appropriately dimensioned bore within said housing.

21. A fault indicator as defined in claim 14 wherein indicator means comprise a rotatably mounted indicator flag, and an indexing magnet and armature means rotatably coupled to said indicator flag and responsive to said first and second applied magnetic fields for positioning said indicator flag in said trip and reset states.

22. A fault indicator as defined in claim 21 which further comprises magnetic indexing means including a first permanent magnet mounted for rotation with said indicator flag and a second permanent magnet fixedly positioned relative to said housing for indexing said indicator flag alternatively in said trip and reset states.

23. A fault indicator as defined in claim 14 wherein flux concentrating means comprise a magnetic pole piece mounted to said housing and at least partially encircling the conductor and having magnetic poles in magnetic communication with said indicator means for conditioning said indicator means to said trip condition.

* * * * *